US006068205A

United States Patent [19]

Vari

[11] Patent Number: 6,068,205

[45] Date of Patent: May 30, 2000

[54] ON-OFF CONTROL FOR SPRINKLERS AND THE LIKE EMPLOYING A SEALING MEMBRANE

[76] Inventor: Peter Vari, 33 Lenape Rd., Richboro, Pa. 18954

[21] Appl. No.: 09/080,972

[22] Filed: May 19, 1998

Related U.S. Application Data

[60] Provisional application No. 60/047,920, May 29, 1997, abandoned.

[51] Int. Cl.[7] ..... A62C 37/36

[52] U.S. Cl. ..... 239/533.1; 169/20; 169/90

[58] Field of Search ..... 239/533.1, 533.13, 239/533.14, 533.15; 169/37, 90, 19, 20

[56] References Cited

U.S. PATENT DOCUMENTS

| | | | |
|---|---|---|---|
| 3,698,483 | 10/1972 | Martin et al. | 169/37 |
| 3,757,866 | 9/1973 | Mears et al. | 169/37 |
| 3,785,440 | 1/1974 | Shea | 169/20 |
| 3,791,450 | 2/1974 | Poitras | 169/37 |
| 3,802,510 | 4/1974 | Johnson | 169/19 |
| 3,848,676 | 11/1974 | Doherty, Jr. | 169/37 |
| 4,085,765 | 4/1978 | Nelson | 169/19 X |
| 4,359,098 | 11/1982 | Johnson | 169/90 |
| 4,368,782 | 1/1983 | Bray | 169/90 |
| 4,553,602 | 11/1985 | Pieczykolan | 169/19 |
| 4,706,758 | 11/1987 | Johnson | 169/19 |
| 4,830,117 | 5/1989 | Capasso | 169/90 |
| 4,830,118 | 5/1989 | Capasso | 169/90 |
| 5,303,778 | 4/1994 | Vari | 169/90 |
| 5,439,028 | 8/1995 | Meyer et al. | 169/19 |

*Primary Examiner*—Andres Kashnikow
*Assistant Examiner*—Sean P. O'Hanlon
*Attorney, Agent, or Firm*—Louis Weinstein

[57] ABSTRACT

In an automatic on-off sprinkler, water enters an inlet and passes through a hollow interior region to the outlet. A reciprocating member in the hollow region normally blocks the outlet when water entering a narrow passageway fills a central chamber above the reciprocating member. A large gap between the hollow region ID and the reciprocating member OD permits friction-free movement of the reciprocating member. A flexible, water-tight diaphragm seals the central region, preventing liquid entering the narrow passageway from communicating with a lower region from passing to the outlet. A sensor detects an emergency condition, unsealing a control opening larger than the narrow passageway, allowing liquid to rapidly escape through the unsealed control, dropping the pressure in the central region, whereby a pressure imbalance lifts the reciprocating member closing the outlet. When the control opening is resealed, liquid pressure in the central region sealed by the water-tight membrane increases. The internal pressure urges the reciprocating member to the closed position when the central region is filled, which condition is maintained during normal temperature conditions. The flexible water-tight diaphragm eliminates the need for O-ring seals which create undesirable frictional forces. The reciprocating member may be spherical or cylindrical and may be formed of a suitable metal or other material. A light closing spring may be provided to normally urge the spool to the closed position. The control valve may be used to control two or more conventional sprinkler heads.

15 Claims, 3 Drawing Sheets

ON-OFF CONTROL FOR SPRINKLERS AND THE LIKE EMPLOYING A SEALING MEMBRANE

This application claims benefit of provisional application Ser. No. 60/047,920 filed May 29, 1997 now abandoned.

FIELD OF THE INVENTION

The present invention relates to sprinkler control devices and, more particularly, to a unique on-off sprinkler control device which has the capability of reclosing upon termination of an emergency condition in readiness for a subsequent emergency and which employs a flexible diaphragm to prevent the flow of water through a gap region between a bore and a member reciprocally mounted therein without the need for conventional sealing devices, such as O-rings, or the like.

BACKGROUND OF THE INVENTION

Sprinkler devices are well known and well accepted devices for protection of homes, offices, factories, and the like, against fire.

Conventional sprinkler devices typically utilize a heat-sensitive element which may, for example, melt at a predetermined temperature enabling a valve to open and spray water upon a predetermined area protected by the sprinkler device. Such devices have the disadvantage of remaining open and being incapable of reclosing due to destruction of the meltable element.

The need as well as the desire to provide sprinkler devices with an on-off capability have led to the development of sprinkler devices which have the capability of opening responsive to an emergency condition and reclosing when the emergency condition terminates. Note, for example, U.S. Pat. No. 3,757,866 which has a pilot valve actuated by a bimetal disk which normally biases the pilot valve to a closed condition, sealing a control opening communicating between a chamber in which a piston is reciprocatingly mounted and an outlet opening. Water enters through an inlet opening and passes through a restricted opening in the center of the piston to fill the aforementioned closed chamber whereby equal water pressure is applied on opposite surfaces of the piston but with the larger surface area of the piston confronting the closed chamber, the piston is urged to the closed position, sealing a second opening communicating between said inlet and said outlet.

The bimetal opens the valve to unseal the control opening when ambient temperature reaches a predetermined level such as 185° F. allowing water in the previously closed chamber to pass through the outlet opening abruptly dropping the pressure applied to the bottom surface of the piston enabling the piston to be moved to a position unsealing the opening between the inlet and outlet.

The valve reseals the control opening between the chamber and the outlet opening responsive to a reduced ambient temperature, typically of the order of 100° F., whereupon the chamber is refilled causing the liquid pressure build-up within the chamber to move the piston back to the position resealing the opening communicating the inlet with the outlet.

The above system, which is described in detail, for example, in U.S. Pat. No. 3,757,866, has a disadvantage of requiring O-ring sealing devices to prevent liquid filling the chamber from reaching the outlet opening, thus increasing the forces required to move the piston to both the sealed and the unsealed positions. The O-rings increase the force needed to move the piston. In addition, the useful operating life of the O-rings is limited, necessitating frequent maintenance and repair. For example, the average shelf life of an O-ring is of the order of fifteen years whereas the average life of a sprinkler device is of the order of fifty years. In addition, the shape of the piston necessitates the provision of two sliding chambers of different diameter for slidably mounting the piston.

Other sprinkler devices having on-off capabilities similar in design to the above-mentioned patent include: U.S. Pat. Nos. 3,698,483; 3,791,450; 3,802,510; 3,848,676; 4,553,602; 4,706,758; 4,830,117 and 4,830,118. The devices of all the above-mentioned patents have the disadvantage of requiring O-ring seals, as well as independent biasing members.

U.S. Pat. No. 4,359,098, in addition to requiring O-ring seals and biasing members, further requires a flexible diaphragm which is subject to wearing and deterioration at a rate equal to or greater than that experienced by the O-rings.

An on-off sprinkler described in U.S. Pat. No. 5,303,778 overcomes the disadvantages of the above prior art by providing a device characterized by a design which provides an in-line control assembly having an intermediate region communicating the inlet of the device to the outlet and containing a reciprocating spool slidably mounted within said intermediate region and movable to a first position displaced from a spool seat surrounding the outlet and a second position engaging the spool seat to seal the outlet. An insert within said region slidably receives the spool and forms a top chamber between the top interior of the insert and the top surface of the spool which communicates with the inlet through a small diameter (i.e. "restricted") orifice.

Water entering the inlet passes through said orifice and through passageways provided between the insert and the interior region to apply pressure to the top and bottom surfaces of the spool. Although the pressure applied to the top and bottom surfaces of the spool are substantially equal, the force of gravity acting upon the spool urges the spool to said second position, sealing the outlet.

A valve controlled by a heat sensor selectively seals and unseals a control opening whose size (i.e. diameter) is significantly greater than the orifice opening in the insert. The control opening is unsealed responsive to a predetermined emergency condition allowing water in the top chamber to pass through the unsealed control opening at a rate faster than water can enter into the restricted opening within the insert thereby abruptly dropping the pressure within the top chamber substantially to zero whereupon the water pressure applied to the bottom surface of the spool displaces the spool from the seat surrounding the outlet to thereby spray the area served by the sprinkler device.

The control opening is reclosed when the emergency condition is terminated causing water entering the restricted opening in the insert to refill the top chamber. Although the pressure applied to the top and bottom surfaces of the spool is substantially equal, the orientation of the spool is such that a gravitational force urges the spool toward the second or closed position, resealing the outlet.

As an alternative embodiment, the spool may be provided with a top surface of greater surface area than the bottom surface to facilitate and enhance the closing operation and to facilitate maintaining the spool and hence the sprinkler device in the closed position. The opening operation is not affected by the modified spool.

Water in the top chamber is prevented from passing from the top chamber to the region surrounding the bottom surface of the spool and hence the outlet by controlling the gap region between the ID of the insert and the OD of the spool to a gap size which is sufficient to provide a watertight seal while enabling the spool to freely move between said first and second positions. This novel seal totally eliminates the need for conventional sliding seal members, such as O-rings, thereby eliminating the need for maintenance and replacement of such sliding seal members as is required in conventional sprinkler devices, as well as significantly reducing the frictional forces acting against the sliding movement of the spool. The novel, vertical, in-line arrangement of the spool takes advantage of gravitational forces, thus eliminating the need for conventional bias members, such as helical springs, or the like.

In an alternative embodiment, the spool may be either a cylindrical-shaped member or a spherical-shaped member.

In still another preferred embodiment, a sprinkler head assembly is mounted adjacent the outlet of the on-off sprinkler device and is provided with a blocking bar which blocks the spool (or ball) from sealing the outlet until the sprinkler device is actuated. This arrangement provides a fail-safe design in the event of a corrosion related failure of the on-off sprinkler device by assuring that the spool would be stuck in the open (i.e. fail-safe) position rather than the closed position.

Although the on-off sprinkler disclosed in U.S. Pat. No. 5,303,778 is superior in most respects to the above-mentioned prior art, is suspected that sediment or particulate or other foreign matter carried by the fluid passing through the sprinkler may collect in the gap, which may restrict the free movement of the reciprocating spool.

BRIEF DESCRIPTION OF THE INVENTION

The present invention is characterized by comprising an in-line control assembly similar to that described in my U.S. Pat. No. 5,303,778 having, in one preferred embodiment, a similar intermediate region communicating the inlet of the device with the outlet and containing a reciprocating member mounted within the intermediate region and movable between a first position displaced from a closing seat surrounding the outlet (responsive to a control valve opening) and a second position engaging the closing seat to seal the outlet (responsive to closing of the control valve). A flexible waterproof membrane is positioned between an end member which is joined to the reciprocating member and the reciprocating member. A top chamber is formed between the top interior of the insert and the top surface of the reciprocating member, the top chamber communicating with the inlet through an orifice (or orifices) of a restricted size.

Water entering the inlet passes through the orifice as well through passageways provided between the insert and the interior region applying pressure to top and bottom surfaces of the reciprocating member. Although pressure applied to the top and bottom surfaces of the reciprocating member and the membrane may be substantially equal, the force of gravity and pressure imbalance acting upon the reciprocating member urges the reciprocating member to the position sealing the outlet.

A valve controlled by a heat sensor selectively seals and unseals a control opening whose size is significantly greater than the restricted orifice opening (or openings) in the insert. The control opening is unsealed responsive to a predetermined emergency condition (typically a predetermined, elevated temperature level) allowing water in the top chamber to pass through the unsealed control opening at a much faster rate than water can enter the restricted opening within the insert, abruptly dropping the pressure within the intermediate chamber substantially to zero whereupon the water pressure applied to the bottom surface of the reciprocating member lifts the reciprocating member from the sealing position whereby water directly flows from the inlet to the outlet through the aforementioned passageways, delivering water to a local or remote spray head for spraying the area served by the sprinkler control device.

The control opening is reclosed when the emergency condition is terminated, causing water entering the restricted opening in the insert to refill the intermediate chamber. Even though the pressure applied to the top and bottom surfaces of the reciprocating member and membrane are substantially equal, the force of gravity and pressure imbalance urges the reciprocating member toward the closed position resealing the outlet.

A screen is preferably provided at the inlet end of the restricted orifice to screen particulate carried by the water (i.e. "dirty water") from entering into the top chamber in which the reciprocating member is arranged to prevent clogging. The watertight member completely prevents water (including "dirty water") from entering into the region of the reciprocating member through said passageways, thus protecting the chamber in which the reciprocating member is positioned.

The use of the waterproof membrane eliminates the need for providing a tight tolerance between the reciprocating member and the surrounding wall of the insert. The reciprocating member may be guided for alignment by means of a cylindrical bore which slidably receives an upper cylindrical-shaped end of the reciprocating member. The waterproof diaphragm also provides guidance and alignment of the lower end of the reciprocating member.

This design assures that the chamber in which the reciprocating member is mounted is kept substantially free of "dirty water" thus assuring proper operation over a long, useful operating life and eliminates the need for tight tolerance between the confronting surfaces of the reciprocating member and the sidewall of the chamber surrounding the reciprocating member, significantly reducing the size and weight of the reciprocating member as well as all of the other components of the on/off sprinkler.

In one embodiment, the flexible membrane may be a rubber or suitable plastic material. In still another embodiment of the present invention, the flexible member may be a flexible metallic diaphragm capable of "snapping" between a closed position sealing the outlet opening and an open position allowing water to flow from the inlet to the outlet through the bypass passageways.

In still another embodiment of the present invention, the same concept as set forth hereinabove may be utilized as a valve means for controlling the flow to a plurality of conventional sprinkler heads, i.e., sprinkler heads of a simplified design in which any form of a heat sensitive control element is eliminated.

OBJECTS OF THE INVENTION

It is therefore one object of the present invention to provide an on/off control for a sprinkler device having a design making advantageous use of gravitational forces and pressure unbalances for closing control of the on/off device.

Still another object of the present invention is to provide an on/off sprinkler control device which eliminates the need for conventional sliding seal devices such as O-rings.

Still another object of the present invention is to provide an on/off sprinkler control device having a design which eliminates frictional drag normally encountered in conventional devices employing reciprocating sealing components.

Still another object of the present invention is to provide an on/off sprinkler control device which eliminates the need for bias members typically required in conventional devices of this type to assure appropriate movement of a reciprocating member between an on and an off (i.e. open and closed) position.

Still another object of the present invention is to provide an on/off sprinkler control device having a simplified in-line arrangement between inlet and outlet in which a reciprocating member and flexible water-tight membrane cooperate to selectively seal the region between inlet and outlet.

Still another object of the present invention is to provide an on/off sprinkler control device having a reciprocally mounted spool which provides a greater surface area for a closing force than the surface area presented for an opening force, thereby facilitating reclosing device.

Still another object of the present invention is to provide a novel on/off sprinkler control device utilizing a reciprocating member and cooperating water-tight membrane arranged within an in-line housing and which eliminates the need for frictional seals and tight tolerance alignments required in conventional devices.

Still another object of the present invention is to provide a novel on/off sprinkler of the type set forth hereinabove wherein the water-tight member is rubber or a rubber-like flexible membrane.

Still another object of the present invention is to provide a novel on/off sprinkler of the type set forth hereinabove wherein the water-tight membrane is a metallic diaphragm.

Still another object of the present invention is to provide a novel on/off sprinkler control device which operates as a valve means for controlling flow to a plurality of conventional sprinkler heads of simplified design.

BRIEF DESCRIPTION OF THE FIGURES

The above, as well as other objects of the present invention, will become apparent when reading the accompanying description and drawings in which.

DETAILED DESCRIPTION OF THE INVENTION AND PREFERRED EMBODIMENTS THEREOF

Figure 1:
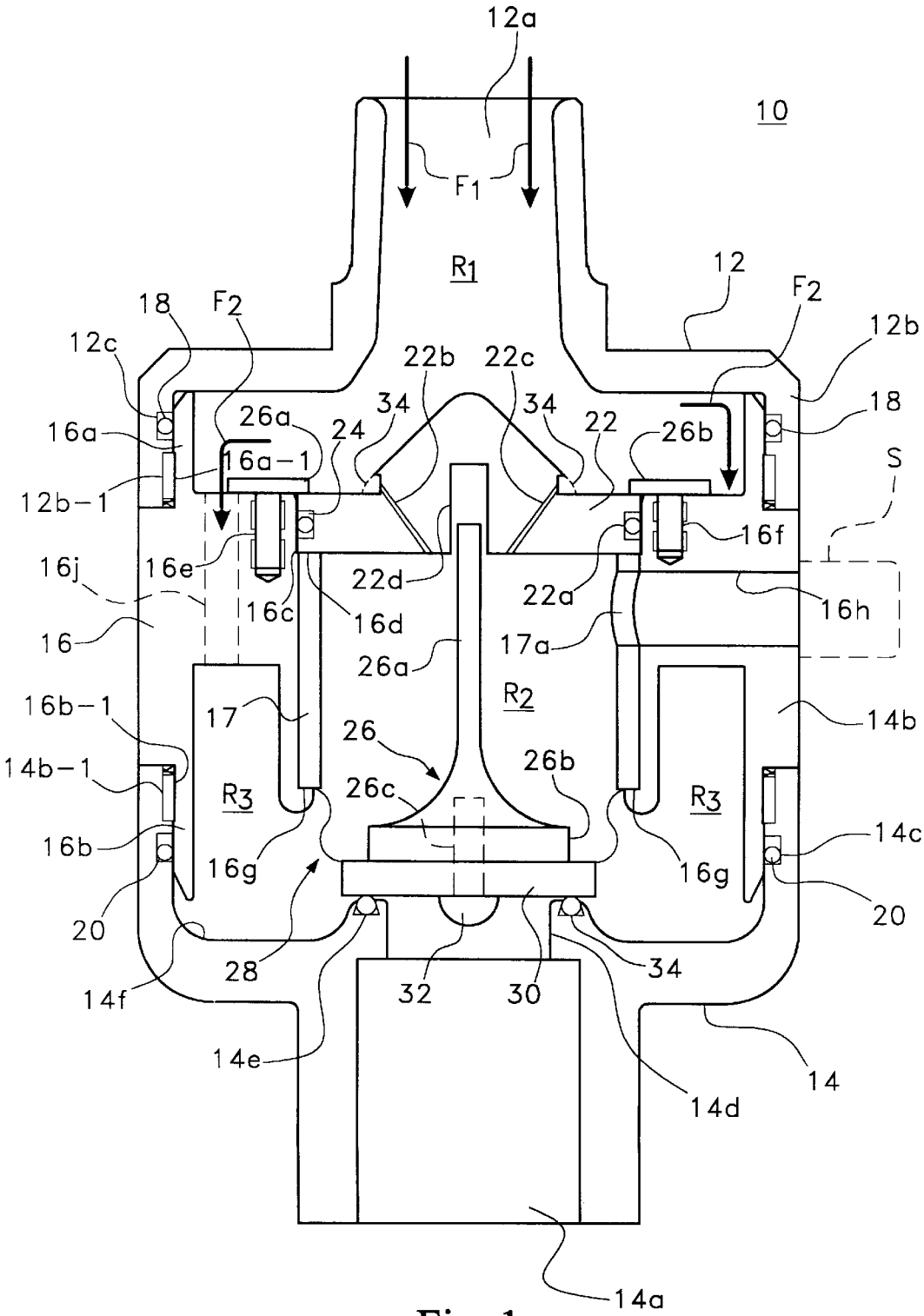
FIG. 1 is a schematic elevation view showing an on/off sprinkler control device embodying the principle of the present invention.

FIG. 1 shows a preferred embodiment 10 of the on/off sprinkler control device embodying the principles of the present invention. The on/off device 10 is comprised of a hollow upper housing portion 12 having inlet 12*a* and a lower housing portion 14 having an outlet 14*a*. An insert 16 is joined to and telescopingly received within housing portions 12 and 14, upper cylindrical projection 16*a* telescoping into the interior of lower, cylindrical end 12*b* of housing portion 12 and the downwardly projecting cylindrical portion 16*b* telescoping into the interior of cylindrical portion 14*b*. The cylindrical portion 16*a* has a threaded portion 16*a*-1 threadedly engaging a threaded portion 12*b*-1. In a similar fashion, cylindrical projection 16*b* has a threaded portion 16*b*-1 threadedly engaging threaded portion 14*b*-1. A cylindrical recess 12*c* extends about the interior of cylindrical portion 12*b* and seats an O-ring 18, which is under compression. Similarly, a cylindrical recess 14*c* seats O-ring 20, which is under compression, the O-rings 18 and 20 providing a liquid tight seal between intermediate body portion 16 and upper and lower housing portions 12 and 14.

A barrier member 22 is arranged within a central opening 16*c* in member 16, and is provided at the upper end thereof and rests upon a cylindrical shoulder 16*d*. Cylindrical-shaped-recess 22*a* seats O-ring 24, which is under compression, providing a liquid tight seal between members 16 and 22. Hollow cylinder 17 is placed within the hollow interior of insert 16 and has its lower end resting on cylindrical shoulder 16*g*. Threaded fasteners 26*a* and 26*b* threadedly engage tapped opening 16*e* and 16*f* in member 16 and overlie the member 22 to secure the member 22 and cylinder 17 to member 16.

Member 22 has a center portion provided with four elongated narrow passageways only two of which, 22*b* and 22*c*, are shown in the figure. The passageways are diagonally aligned and are arranged at equi-spaced, 90° intervals providing communication between upper interior region $R_1$ and central $R_2$.

The underside of member 22 is provided with a central bore 22*d* for slidably receiving the upper, rod-shaped end 26*a* of reciprocating member 26, which rod 26*a* tapers gradually outwardly forming a base portion 26*b*. The upper end of rod portion 26*a* freely reciprocates within opening 22*d*. A water-tight membrane 28 has a central portion thereof clamped between a plate 30 and the under surface of base portion 26*b*. Threaded fastener 32 threadedly engages a tapped opening 26*c* in reciprocating member 26 to secure plate 30 and the central portion of membrane 28 to member 26.

The outer perimeter of water tight membrane 28 is positioned between a cylindrical shoulder 16*g* and the lower edge of hollow cylindrical sleeve 17 and is under compression so as to provide a liquid tight seal thereat.

Lower housing member 14 may optionally be provided with a central opening 14*d* at the upper end thereof, which is selectively covered by plate 30. The cylindrical recess 14*e* seats an O-ring 34 which is engaged by the undersurface of plate 30 when the control device is in the off condition to provide a suitable water-tight seal.

Cylindrical sleeve 17 is provided with an opening 17*a*, which is aligned with a radially aligned bore 16*h* provided in member 16.

Although not shown, for purposes of simplicity, it should be understood that member 16 is provided with several passageways (typically three (3)) arranged at 120° intervals about member 16 aligned parallel to a central axis of control device 10. One such passageway 16*j* is shown in dotted fashion and serves to communicate region $R_1$ with region $R_3$. The other (unshown) passageways function in a similar manner. A greater or lesser number of passageways may be provided, if desired.

In operation, the radially aligned bore 16*h* is typically fitted with a sensor and control assembly S shown in dotted fashion, which includes a heat sensor and a valve mechanism. The heat sensor may be any conventional heat sensor such as, for example, any one of those described in U.S. Pat. Nos. 3,757,866; 3,848,676; and 4,553,602, which are utilized to operate the valve assembly within the sensor assembly S to move between a closed position sealing opening 16*h* and an open position.

Sensor assembly S provides a heat sensor which moves to a first state when the temperature is raised above a predetermined level, for example, 180° F., to open the valve assembly. When the ambient temperature drops to a safe level, for example, of 100° F., the heat sensor operates to close the valve assembly. The valve assembly may be any conventional type, such as, for example, any of those disclosed in the aforementioned '866; '676 and '602 patents.

Assuming the ambient temperature to be below 185° F., the heat sensor maintains the valve assembly in a closed state. Water flowing into inlet 12*a* represented by flow lines F1, flows downwardly through region $R_1$, passes through the passageways such as passageway 16*j* (see flow lines $F_2$) and fills region $R_3$ applying an "upward" pressure against the water-tight membrane 28.

Water entering region $R_1$ also flows through the four constricted openings (only constricted openings 22*b* and 22*c* being shown) and fills the region $R_2$. The pressure applied by the water which fills region $R_2$ extends over a greater surface area (which includes the exposed surface of water tight membrane 28 as well as reciprocating member 26) which is a greater surface area than that confronted by the water which has filled region $R_3$. In this case, the plate 30 and reciprocating member 26 are pressed against the O-ring 34 preventing the flow of water through opening 14*d* and outwardly through 14*a*.

Even assuming the plate 30 to be separated from O-ring 35 when the sensor assembly S closes its control valve, although the pressures on opposite sides of the liquid tight membrane 28 are substantially equal, the gravitational force normally exerted on the device and pressure unbalance due to a pressure drop through 14*d*, urges the reciprocating member to the closed position shown in the Figure.

The curved interior surface 14*f* of lower housing portion 14 causes water to flow smoothly from region $R_1$ to region $R_3$ through passageways such as 16*j* and prevent turbulent flow in the region $R_3$ to outlet 14*a* when outlet 14*a* is unsealed.

Even though the reciprocating member may be displaced from the solid line position shown in the figure, the pressure acting on the liquid-tight membrane and reciprocating member 26 and 28 acts over a greater surface area than the pressure applied from the liquid in region $R_3$ and the gravitational force cooperates therewith serving to maintain the control device in the closed position.

When the ambient temperature reaches a level sufficient to indicate the need for emergency action, the heat sensor in the sensor assembly S opens the control valve provided therein thereby opening the previously closed bore 16*h*. The size of bore 16*h* and 17*a* is significantly greater than size of the passageways 22*b*, 22*c* whereby the water in region $R_2$ rushes out of openings 17*a* and 16*h* at a much greater rate then water flowing into region $R_2$ through narrow passageways 22*b*, 22*c* causing the pressure to drop abruptly to substantially zero. This pressure differential across the membrane acts on water-tight membrane 28 and plate 30 causing these members to move upwardly and thereby unseal the opening 14*d*, enabling the flow of water to a sprinkler head (or heads) or other devices coupled to opening 14*a* of lower housing 14.

The opening 14*d* remains unsealed so long as the valve forming part of the sensor assembly S remains open, since the flow of water moves along the path of least resistance, i.e. through the passageways such as passageway 16*j*, region $R_3$ and out through unsealed opening 14*d*.

When the ambient temperature drops to a sufficiently safe level, the heat sensor in sensor assembly S operates the valve assembly to close bore 16*h*. The flow of water through passageways 22*b* and 22*c* (as well as the unshown passageways) ultimately fill region $R_2$, at which time the reciprocating member 26 and watertight membrane are returned to the closed position shown in the Figure.

The significantly large clearance spacing between the outer periphery (OD) of reciprocating member 26 and interior surface (ID) of hollow cylinder 17, and the adequate clearance space between the upper portion 26*a* of reciprocating member 26 and opening 22*d* substantially eliminates any frictional engagement therebetween thereby eliminating wearing of adjacent components which experience movement relative to one another.

The members 12, 14, 16, 22, 26 and 30 may be made of suitable metal or plastic depending upon the objectives of the user and the applications for the device.

If desired, a screen 34 may be positioned above each of the upper, inlet ends of the passageways, such as passageways 22*b* and 22*c*, to prevent the accumulation of any particulate or foreign matter which might clog the passageways.

Figure 2B:
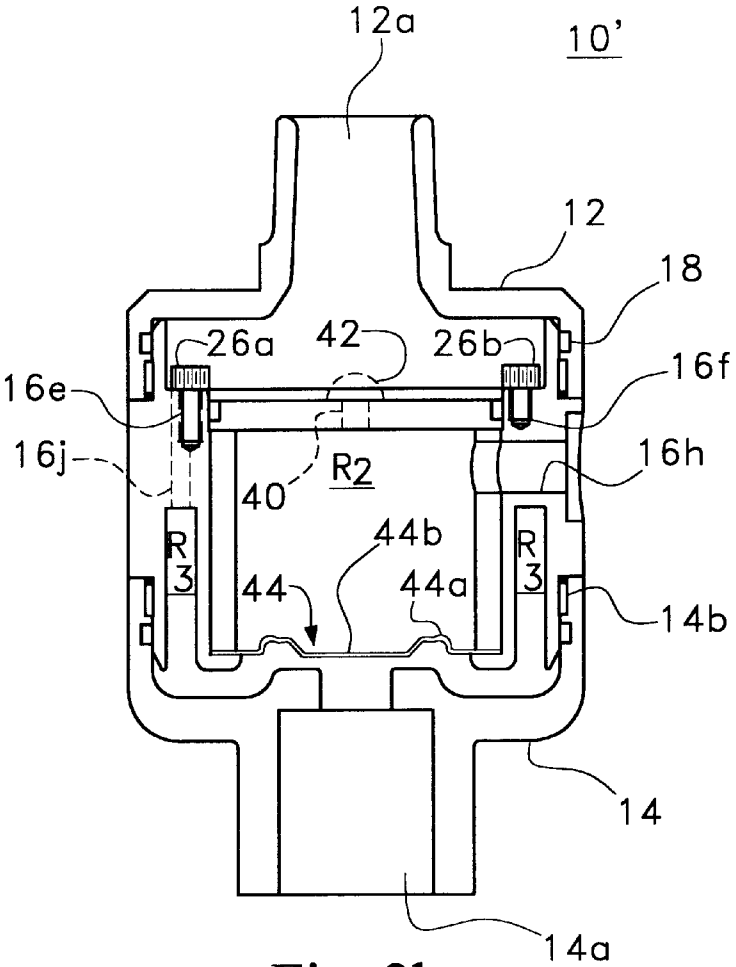
FIGS. 2*a* and 2*b* show an on/off sprinkler control device showing another alternative embodiment in which a metallic diaphragm is utilized, FIGS. 2*a* and 2*b*, respectively showing the device in the closed and opened positions.
Figure 2A:
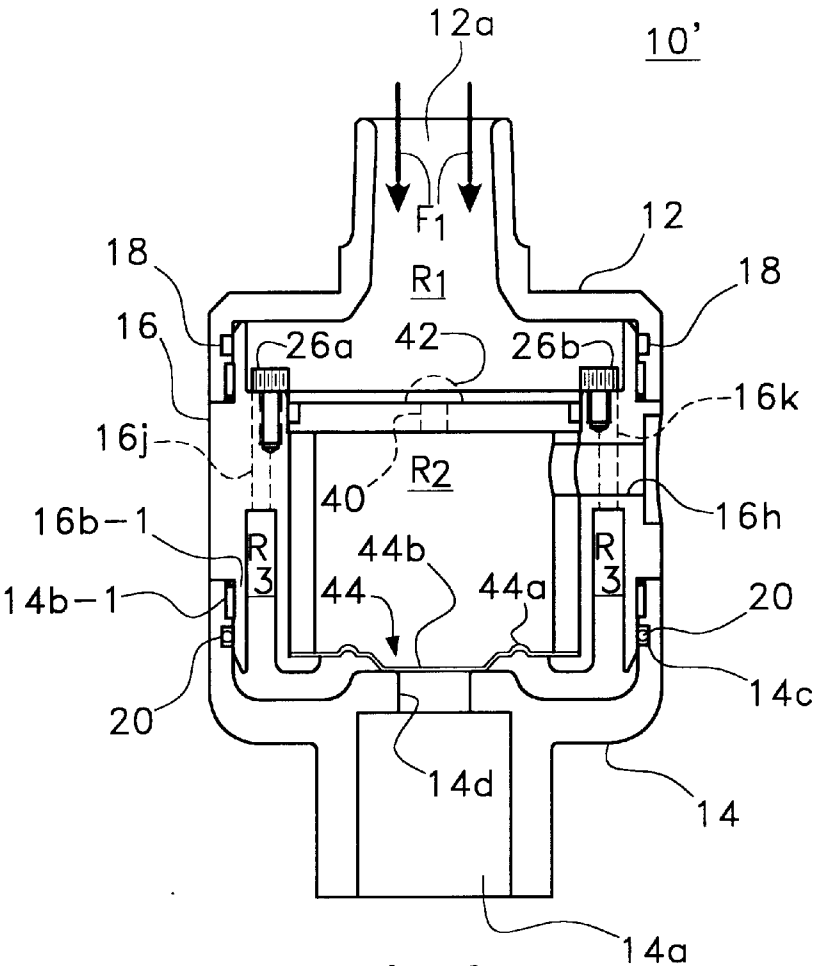

FIGS. 2*a* and 2*b* show an on/off sprinkler head 10' substantially similar in design to the sprinkler head 10 of FIG. 1, wherein like elements are designated by like numerals and only those elements which differ as between FIG. 1 and FIGS. 2*a* and 2*b* will be discussed herein, for purposes of simplicity.

In place of the inlet openings 22*b*, 22*c*, shown in FIG. 1, a single inlet opening 40 is provided. Opening 40 may be covered by a suitable screen 42 to prevent particulate, sediment, or the like, from clogging the flow paths.

The reciprocating member 26 of FIG. 1 is eliminated and is replaced by a metallic diaphragm 44 which is preferably a circular disk having one or more annular undulations 44*a* which enable the central portion 44*b* to "snap" between an upper (open—FIG. 2*b*) and a lower (closed—FIG. 2*a*) position.

The embodiment 10' of FIGS. 2*a* and 2*b* operates in the following manner:

When a sensor coupled to opening 16*h* (see sensor S in FIG. 1) detects normal temperature, opening 16*h* is closed. Liquid flows through inlet 12*a* as shown by arrows F1 and passes through passage-way 40 as well as through the side passage-ways such as 16*j*, 16*k*, provided at spaced intervals about intermediate member 16. Eventually the central region R2 fills, causing pressure to be applied to the interior side of metallic diaphragm 44. This pressure together with the force of gravity, causes diaphragm 44 to snap into the closed position shown in FIG. 2*a* preventing the flow of fluid from inlet 12*a* through outlet 14*a* by way of passages 16*j*, 16*k*. It has been found that the pressure alone acting on the interior surface of diaphragm 44 causes it to "snap" to the closed position. For example, the diaphragm 44 closes even when the assembly 10' is aligned so that this longitudinal axis is horizontally aligned.

Upon detection of an elevated temperature which indicates an ambient condition of concern, the sensor opens whereupon liquid flows through opening 16*h*, which is significantly greater in diameter than opening 40, at a rate much greater than liquid can flow through opening 40. The pressure on the upper surface of diaphragm 44 is significantly reduced causing the diaphragm central portion 44*b* to snap to the open position, due to the pressure imbalance, allowing fluid to pass from inlet 12*a* to outlet 14*a* through the passage-ways such as 16*j*, 16*k*.

When ambient temperature is sufficiently reduced, the sensor closes, enabling central region R2 to refill and eventually the internal pressure thereby causes the diaphragm 44 to snap into the closed position as shown in FIG. 2*a*. Metallic diaphragms, in addition to providing the desired operation, have been found to be suitable to provide a significantly long, useful operating life.

Figure 3A:
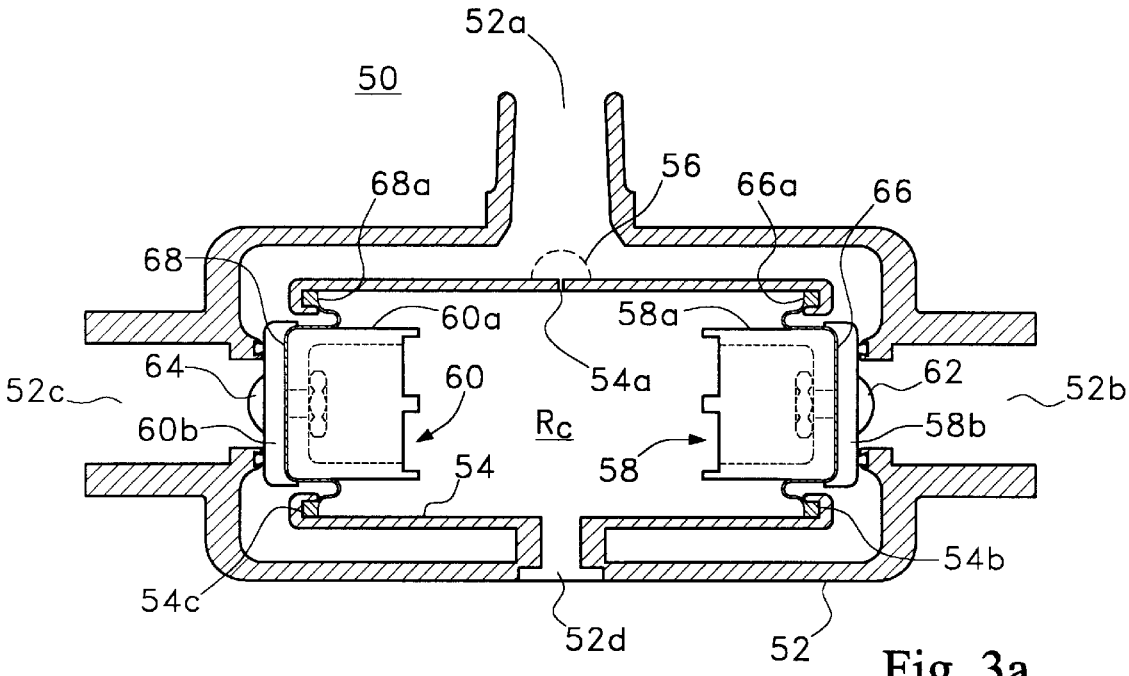
FIGS. 3*a* and 3*b* show a device embodying the principles of the present invention and which is utilized as a control valve for controlling a plurality of conventional sprinkler heads of simplified design.
Figure 3B:
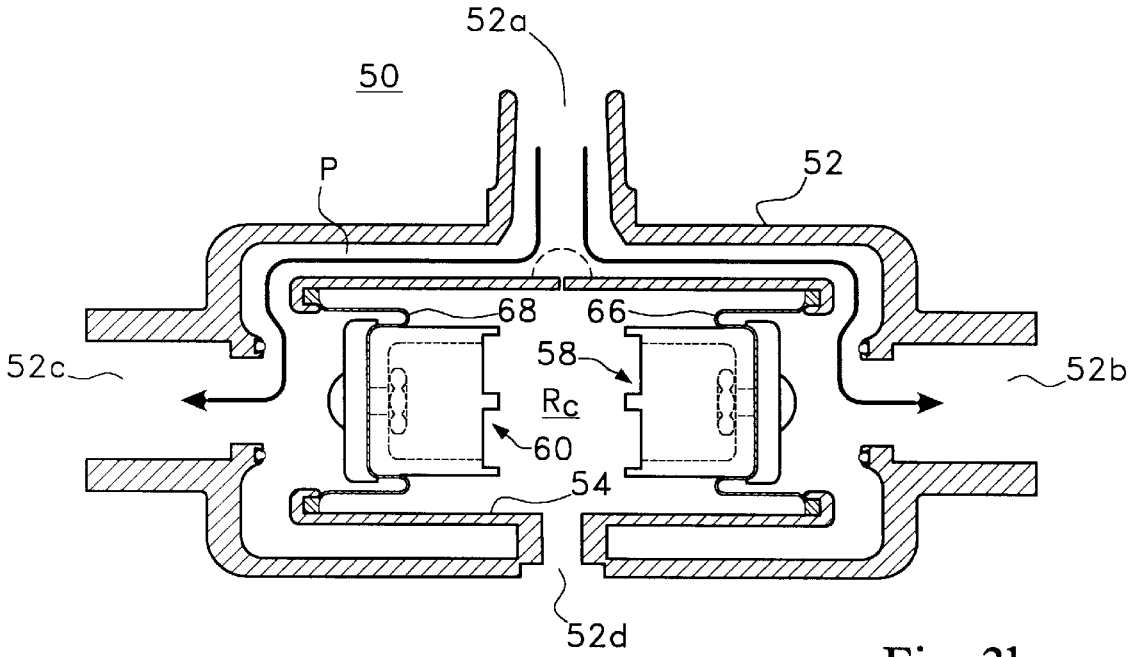

FIGS. 3*a* and 3*b* show another embodiment of the present invention in which the novel arrangement of the present invention is utilized as a control valve for controlling flow to conventional sprinklers. For example, assuming that an area is to be protected by four sprinklers arranged at appropriately spaced intervals about the ceiling of a room or other region to be protected, as an alternative to providing resettable on/off control means of the type shown in FIGS. 1 and 2*a*–2*b*, the number of control means per sprinkler head may be significantly reduced by providing a valve design embodying the principles of the present invention and providing fluid to a plurality of conventional heads of simplified design and reduced complexity, thereby reducing the number of on/off control valves required per sprinkler head.

FIGS. 3*a* and 3*b* show a control valve design in which at least two sprinkler heads of conventional design are supplied by a single valve. The sprinkler heads are of conventional design. The control valve 50 of the present invention, is shown in the closed state in FIG. 3*a* and the open state in FIG. 3*b*. The control valve 50 comprises a housing 52 having an intake opening 52*a* and a pair of outlet openings 52*b*, 52*c*. A sensor port 52*d* is arranged opposite intake opening 52*a*. An integral interior, cylindrical-shaped structure 54, integrally joined to housing 52 is further provided with an inlet opening 54*a* arranged facing the inlet opening 52*a*. A screen 56 may be provided to prevent particulate, sediment, or the like from clogging opening 54*a*. A pair of reciprocating members 58, 60 are mounted adjacent each of the outlet openings 52*b*, 52*c*. Each reciprocating member is formed of a hollow portion 58*a*, 60*a*, preferably opened at their respective left- and right-hand ends. An end cap portion 58*b*, 60*b* is secured to its associated hollow member 58*a*, 60*a* by suitable fastening means 62, 64, sandwiching a suitable diaphragm 66, 68 therebetween so that the intermediate or central portion of each diaphragm 66, 68 is clamped between members 58*b*, 58*a* and 60*b*, 60*a*, the outer free ends of the disk-shaped diaphragms 66*a*, 68*a* being secured within suitable annular-shaped channels 54*b*, 54*c* provided in interior, cylindrical-shaped housing portion 54.

The manner of operation of the control valve 52*a* is as follows:

at least one and preferably two or more conventional sprinkler heads are coupled to each of the outlet openings 52*b*, 52*c*. When a sensor (see FIG. 1), coupled to the sensor port 52*d* detects a safe temperature level, sensor port 52*d* is closed whereupon fluid entering intake 52*a* flows through small opening 54*a* as well as against the outer surfaces of diaphragm 66 and 68. When central region $R_c$ fills, the pressure build-up in the central region urges the reciprocating members 58, 60 to the closed position preventing the flow of fluid from intake 52*a* to either of the outlets 52*b*, 52*c*.

When a sensor coupled to sensor port 52*d* senses an elevated temperature of a dangerous level, sensor port 52*d* is opened causing the flow of fluid out of port 52*d* at a rate significantly greater than the flow of fluid through opening 54*a* causing a pressure imbalance whereupon reciprocating members 58 and 60 move from the closed position shown in FIG. 3*a* to the open position shown in FIG. 3*b* enabling fluid entering intake 52*a* to move along the passage-way P, for example, and flow out of outlets 52*a*, 52*b*.

When a safe temperature level is again detected, sensor port 52*d* is closed, enabling fluid entering narrow diameter open 54*a* to increase the pressure in the central region $R_c$ to a level sufficient to return the reciprocating members 58, 60 to the closed positions shown in FIG. 3*a* preventing any further fluid flow through the outlet 52*b* and 52*c* and hence halting flow to the conventional sprinkler heads coupled thereto.

The control valve 50, in addition to providing a novel re-settable device, further provide a significant reduction in the number of on/off control valves per sprinkler head required in a sprinkler system, thus significantly reducing the cost of a system as well as its installation and maintenance.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Control apparatus for sprinklers and the like, comprising:

a housing having an inlet opening and an outlet opening and at least one intermediate passageway communicating said inlet opening with said outlet opening;

a central region positioned between said inlet and outlet openings and separated from said passageway;

a reciprocating member mounted in said central region and movable between a first position sealing said outlet opening and a second position displaced from said outlet opening;

a control opening communicating with said central region;

sensing means having a first condition normally sealing said control opening and a second condition unsealing said control opening responsive to a predetermined external condition;

a narrow passageway communicating said central region with said inlet opening to deliver water entering said inlet opening into said central region to exert fluid pressure against an upper portion of said reciprocating member to urge said reciprocating member to seal said outlet opening;

said control opening, when unsealed, enabling water in said central region to be diverted to and through said control opening, reducing the fluid pressure upon said reciprocating member, a flow rate of water out of said control opening being greater than a flow rate through said narrow passageway, causing a pressure imbalance across said reciprocating member to move said reciprocating member to said second position to provide water to a sprinkler;

a flexible, resilient, water-tight membrane sealing a lower end of the central region to permit fluid flow into the central region only through said narrow passageway and to prevent fluid in a region of said outlet opening from entering said central region regardless of the position of said reciprocating member; and a central portion of said membrane being fixedly secured to said reciprocating member.

2. The control apparatus of claim 1 wherein a large gap space is provided between an outer periphery of said reciprocating member and an inner periphery of said central region to permit the reciprocating member to freely move between said first and second position and to prevent frictional engagement therebetween.

3. The control apparatus of claim 1 wherein said central portion is located between an underside of said reciprocating member and a cover member secured to an underside of said reciprocating member so as to sandwich the central portion therebetween.

4. The control apparatus of claim 1 further comprising an O-ring seal for surrounding said outlet opening, said reciprocating member engaging said O-ring seal when in said first position.

5. The control apparatus of claim 1 wherein said membrane is a metallic flexible diaphragm.

6. The control apparatus of claim 5 wherein said diaphragm is a disc-shaped member capable of flexing to attain open and closed positions.

7. Control apparatus for sprinklers and the like, comprising:

a housing having a single inlet opening and first and second outlet openings and at least one intermediate passageway communicating said inlet opening with said outlet openings;

an interior central region positioned between said inlet and outlet openings and separated from said passageway;

first and second reciprocating members mounted in said central region, each being adjacent to one of said outlet openings and movable between a first position sealing its associated outlet opening and a second position displaced from its associated outlet opening;

a single control opening communicating with said central region;

sensing means having a first condition normally sealing said control opening and a second condition unsealing said control opening responsive to a predetermined external condition;

a narrow passageway communicating said central region with said inlet opening to deliver fluid entering said inlet opening to exert fluid pressure against interior portions of both of said first and second reciprocating members to urge said reciprocating members to seal their respective outlet openings;

said control opening, when unsealed, enabling fluid in said central region to be diverted to and through said control opening, reducing the fluid pressure upon said first and second reciprocating members, a flow rate of fluid out of said control opening being greater than a flow rate through said narrow passageway, enabling a fluid pressure imbalance acting upon the reciprocating members to move both of said reciprocating members to their said second positions to provide water directly to sprinkers; and first and second flexible, resilient, water-tight membranes sealing opposing ends of the central region to permit fluid flow into the central region only through said narrow passageway and to prevent fluid in a region of each of said outlet openings from entering said central region.

8. The control apparatus of claim 7 wherein said first and second reciprocating members are arranged at opposite ends of said central region and move in opposite directions respectively toward one another to unseal said outlet openings and away from one another to seal said outlet openings.

9. The control apparatus of claim 7 wherein said inlet opening is equidistant from said outlet openings.

10. The control apparatus of claim 7 wherein said control opening is equidistant from said outlet openings.

11. The control apparatus of claim 7 wherein said narrow passageway is equidistant from said outlet openings.

12. Control apparatus for sprinklers and the like, comprising:

a housing having an inlet opening and an outlet opening and at least one intermediate passageway communicating said inlet opening with said outlet opening;

a central region positioned between said inlet and outlet openings and separated from said passageway;

a reciprocating member mounted in said central region and movable between a first position sealing said outlet opening and a second position displaced from said outlet opening;

a control opening communicating with said central region;

sensing means having a first condition normally sealing said control opening and a second condition unsealing said control opening responsive to a predetermined external condition;

a narrow passageway communicating said central region with said inlet opening to deliver water entering said inlet opening into said central region to exert fluid pressure against an upper portion of said reciprocating member to urge said reciprocating member to seal said outlet opening;

said control opening, when unsealed, enabling water in said central region to be diverted to and through said control opening, reducing the fluid pressure upon said reciprocating member, a flow rate of water out of said control opening being greater than a flow rate through said narrow passageway, causing a pressure imbalance across said reciprocating member to move said reciprocating member to said second position; and said reciprocating member comprising: a flexible, resilient, water-tight membrane completely sealing a lower end of the central region to permit fluid flow into the central region only through said narrow passageway and to prevent fluid in a region of said outlet opening from entering said central region regardless of the position of the reciprocating member.

13. The control apparatus of claim 12 wherein said membrane is a metallic flexible diaphragm.

14. The control apparatus of claim 13 wherein said diaphragm is a disc-shaped member capable of flexing to attain open and closed positions.

15. The control apparatus of claim 13 wherein said metallic diaphragm is provided with at least one annular undulation enabling a central portion of the diaphragm to snap between an open and a closed position.

* * * * *